US011027800B1

(12) United States Patent
Jopling

(10) Patent No.: US 11,027,800 B1
(45) Date of Patent: Jun. 8, 2021

(54) FLOATING HULL PAD SYSTEM AND METHOD OF ITS USE

(71) Applicant: HydroHoist, LLC, Claremore, OK (US)

(72) Inventor: Kent Jopling, Tulsa, OK (US)

(73) Assignee: HydroHoist, LLC, Claremore, OK (US)

( * ) Notice: Subject to any disclaimer, the term of this patent is extended or adjusted under 35 U.S.C. 154(b) by 0 days.

(21) Appl. No.: 16/829,596

(22) Filed: Mar. 25, 2020

Related U.S. Application Data

(60) Provisional application No. 62/823,086, filed on Mar. 25, 2019.

(51) Int. Cl.
*B63C 3/06* (2006.01)
*B63C 1/02* (2006.01)

(52) U.S. Cl.
CPC ..... *B63C 1/02* (2013.01)

(58) Field of Classification Search
CPC ..... B63C 3/12; B63C 3/06
USPC ..... 405/1, 3, 4, 7
See application file for complete search history.

(56) References Cited

U.S. PATENT DOCUMENTS 4,084,528 A * 4/1978 Itani ..... B63B 71/00 114/45
5,915,877 A * 6/1999 Sargent ..... B66F 7/025 114/44
6,752,096 B2 * 6/2004 Elson ..... B29C 41/04 114/292
6,964,239 B2 * 11/2005 Vinnik ..... B63C 1/02 114/44
2002/0150427 A1 * 10/2002 Godbersen ..... B66F 7/04 405/3
2012/0312214 A1 * 12/2012 Hey ..... B63C 1/06 114/46

* cited by examiner

*Primary Examiner* — Sean D Andrish
(74) *Attorney, Agent, or Firm* — GableGotwals

(57) ABSTRACT

Embodiments of a floating bunk system of this disclosure include a hull pad assembly extending in a longitudinal direction and including two hull pads spaced apart from one another and, at each end of the hull pad assembly, a sliding guide assembly including a pair of guide poles, each guide pole of the pair extending in a vertical direction; an upper end channel extending in a lateral direction and connected to the hull pad assembly and to the pair of guide poles; a lower end channel extending in the lateral direction and including a pair of lower bushings; each lower bushing receiving a respective guide pole; the upper end channel being in a fixed position relative to the pair of guide poles; the lower end channel being slidably vertically displaceable along the guide poles toward and away from the upper end channel.

9 Claims, 4 Drawing Sheets

FLOATING HULL PAD SYSTEM AND METHOD OF ITS USE

CROSS-REFERENCE TO CO-PENDING APPLICATIONS

This application claims priority to U.S. 62/823,086 filed Mar. 25, 2019.

BACKGROUND

This disclosure is in the field of floating lifts and lift system used to raise and lower a watercraft out of and in to a body of water. More particularly, the disclosure is directed toward the lift's hull pad or bunk system.

SUMMARY

Embodiments of a floating bunk system of this disclosure include a hull pad assembly extending in a longitudinal direction with two hull pads spaced apart from one another and, at each end of the bunk system, an upper (floating) end channel connected to the hull pads, a lower (boat lift) end channel connected to lift floats, and a sliding guide assembly located between the two end channels. The sliding guide assembly may include a pair of guide poles extending in a vertical direction and received by bushings on each of the end channels. In some embodiments, the guide poles may be cylindrical shaped. In other embodiments, the guide poles may be t-shaped (in cross-section). The upper end channel is in a fixed position relative to the guide poles and the lower end channel is slidably displaceable along the guide poles toward and away from the upper end channel.

In some embodiments, the two hull pads include flotation. Where a cylindrical-shaped guide pole is used, the upper and lower bushings may include complementary locking means for temporarily securing the upper and lower end channels to one another. The upper end channel may include one or more guide pads configured to receive the lower end channel. At least one of the upper and lower end channels may include a plurality of spaced apart openings configured to receive a fastener. The hull pad assembly may include a bracket having a plurality of spaced apart openings configured to receive a fastener. The system may further include a pair of floats extending in the longitudinal direction between the first and second ends, with the lower end channels connected to the pair of floats F.

When in an intended use as part of a boat lift, embodiments of a floating hull pad or bunk system of this disclosure:

- reduce the skill level required by a boater to dock a boat;
- hold a boat in a stable position without raising the lift;
- provide a boater time to unload and load from water level not from a raised position;
- allow a boater to pull in and side dock a boat without lowering the bunks, and it acts as a holding mechanism,
- require no effort from the boater to keep the boat secure when pulled on the bunks;
- do not put pressure on the dock while the boat is being held in the docked position;
- auto corrects (self-aligns) the boat as the boater pulls in the slip, pulling the boat straight and true to center of the system without the boater's input;
- when in a raised position, fully lock into place on the lift and behave as a normal (prior art lift) without the floating bunk system feature.
- include positive lock to keep the floating bunk system secure when the lift is in a raised position
- have no metal on metal contact on guides to add to the life of the lift; and
- can lock the floating bunk system so that it sinks with the lift.

DETAILED DESCRIPTION

Figure 1:
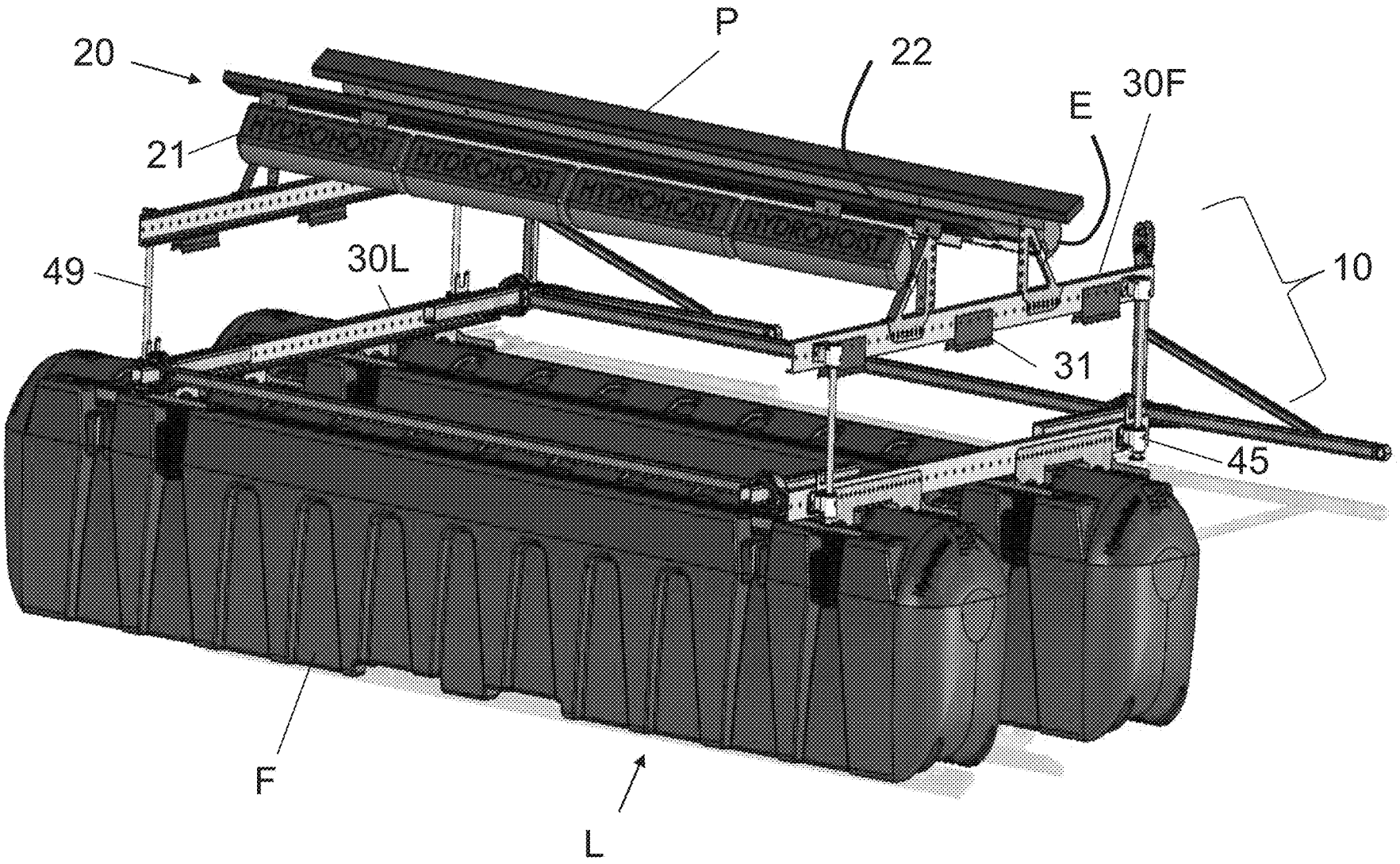
FIG. 1 is an embodiment of a floating hull pad system of this disclosure mounted on a prior art lift.
Figure 2:
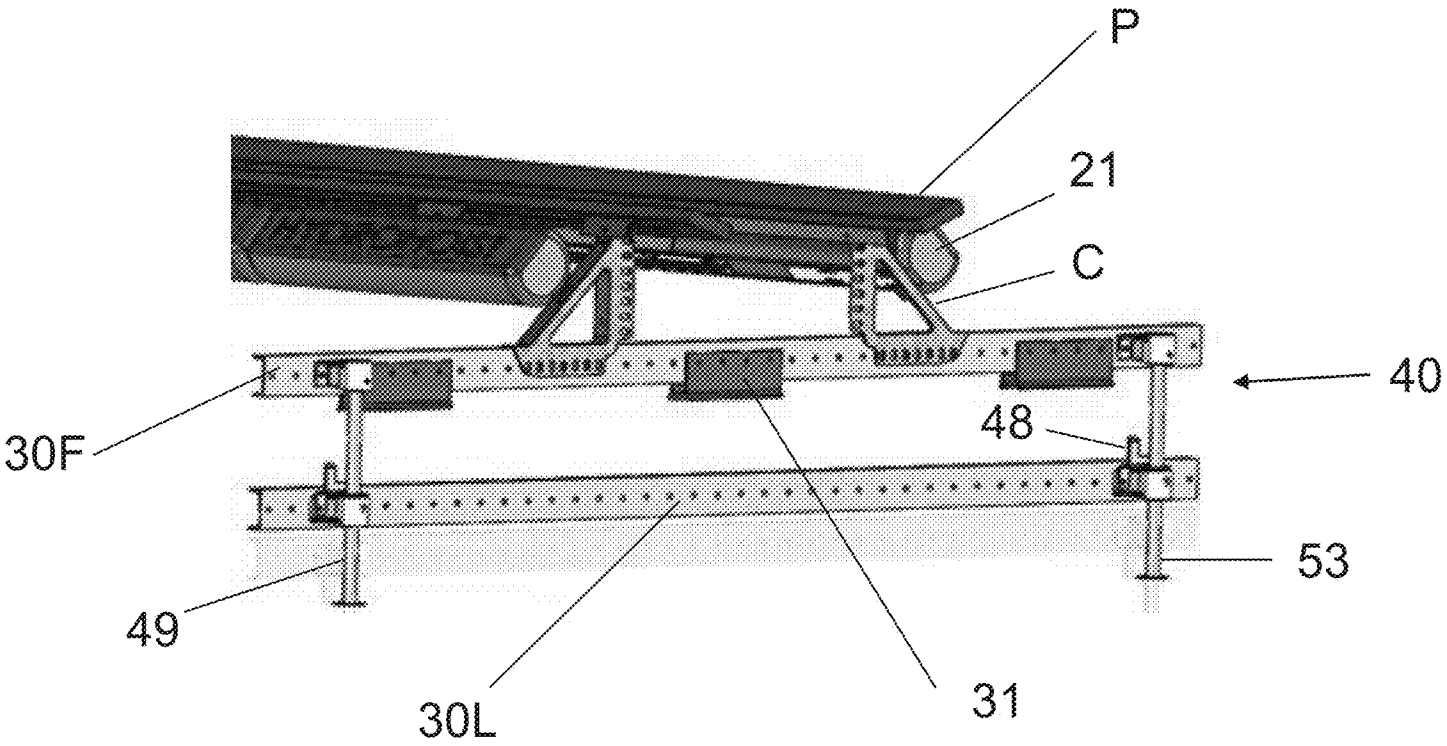
FIG. 2 is a detail view of the floating hull pad system of FIG. 1.
Figure 3A:
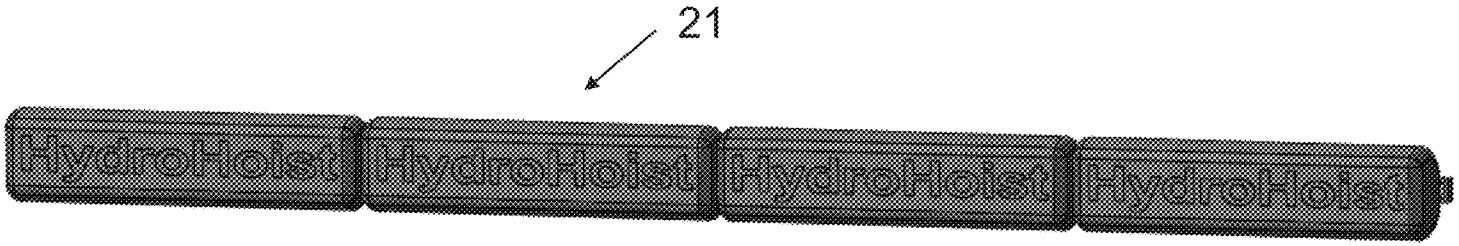
FIG. 3A is a front isometric view of an embodiment of the floating assembly.
Figure 3B:
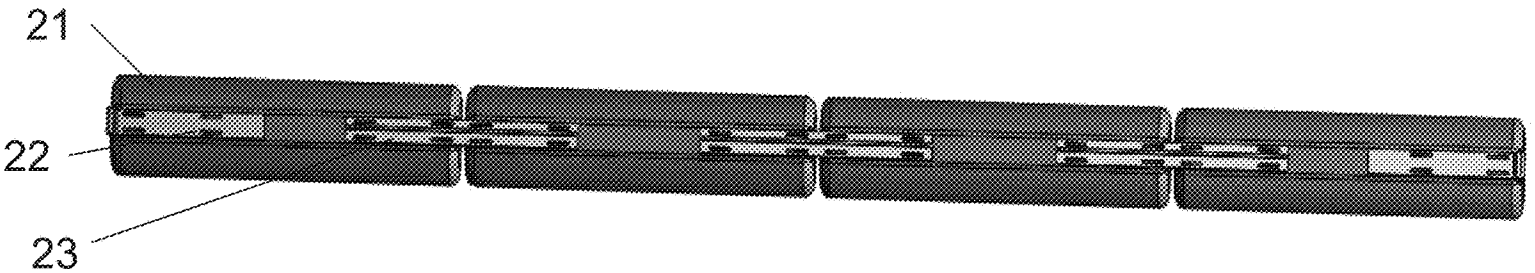
FIG. 3B is a rear isometric view of the floating assembly of FIG. 3A.
Figure 6:
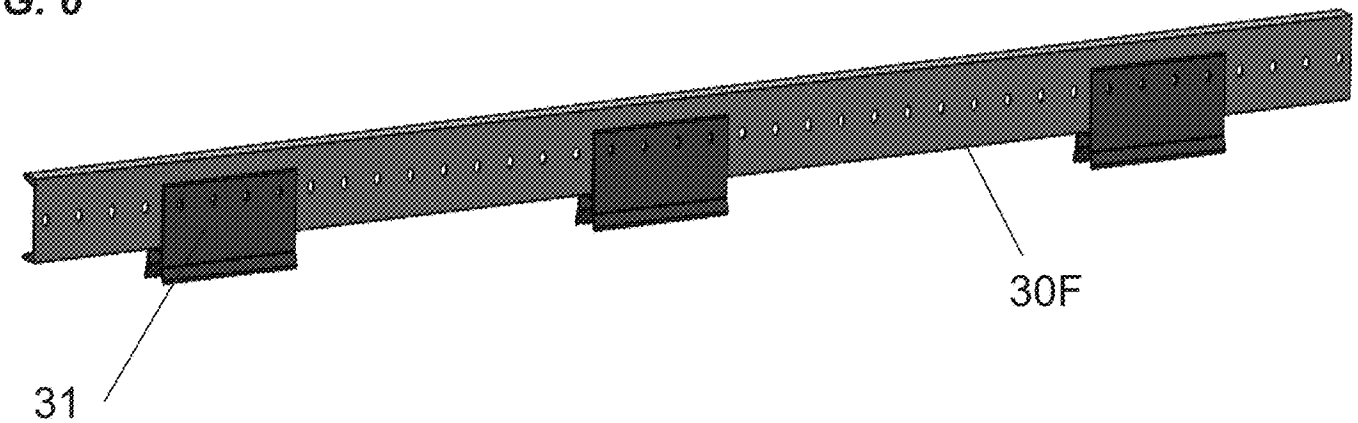
FIG. 6 is a view of an embodiment of the end channel guide assembly.
Figure 5:
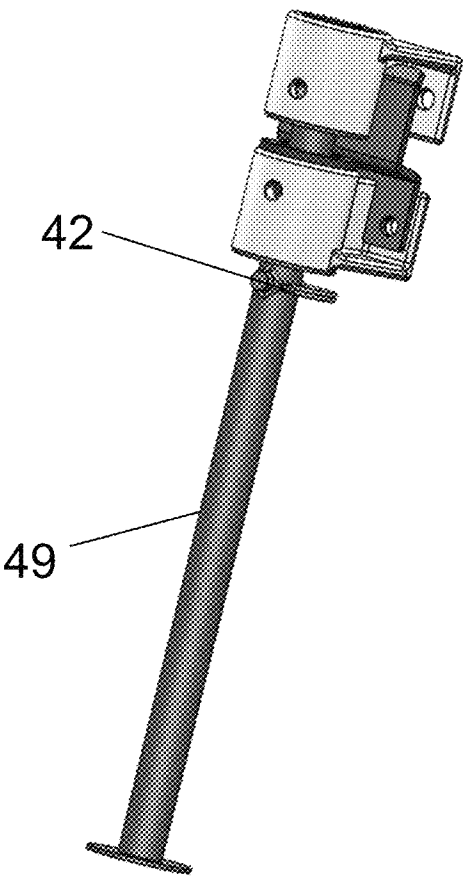
FIG. 5 is a view of the slide guide assembly of FIG. 4 when in a locked position.
Figure 4:
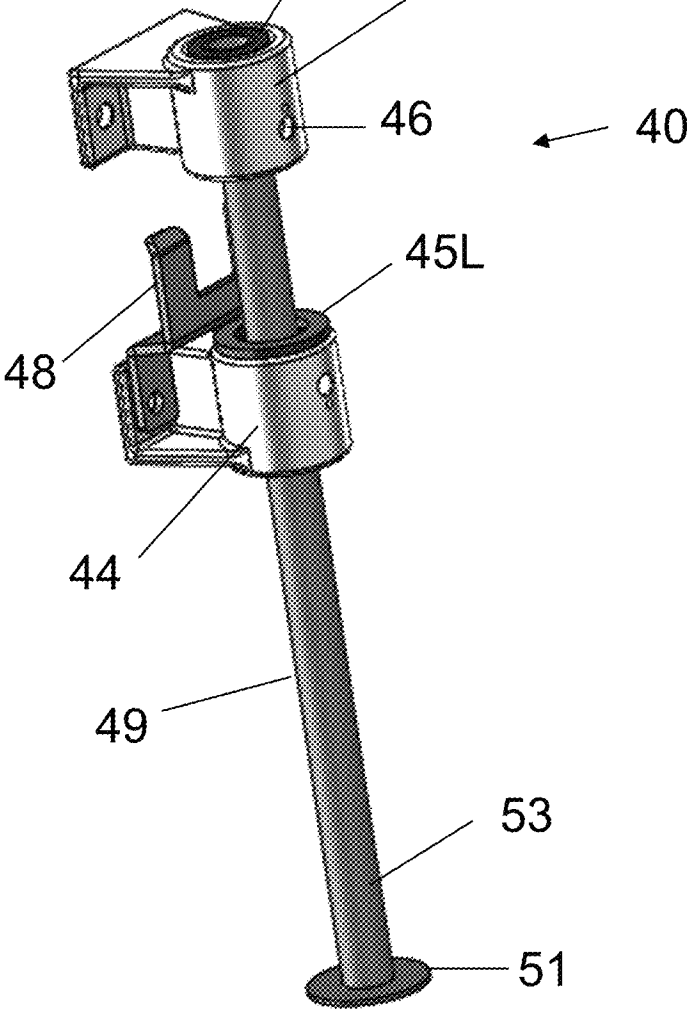
FIG. 4 is a view of an embodiment of the slide guide assembly when in an unlocked position.

Referring to the drawings, embodiments of a floating hull pad or bunk system 10 of this disclosure include a hull pad float assembly 20 connected to a floating end channel 30F that rides on a slide guide assembly 40 located at each end E of the system 10, the slide guide assembly 40 also being connected to a boat lift end channel 30L (which, in turn, is connected to the lift float Fs). The system 10 makes use of the buoyancy of the hull pad floats 21, with the hull pads P floating on the surface of the water in any water conditions. As the boat lift L starts to lift, the slide guide assembly 40 aligns the floating end channel 30F on to the boat lift end channel 30L.

In some embodiments, when the channels 30L, 30F make contact with one another, the bunk system locks in place by way of a locking mechanism 48 and the system 10 lifts in a traditional manner. As the boat lift L lowers and the hull pad floats 21 enter the water, the buoyancy of the floats 21 causes the attached hull pad assembly 20 to float as the slide guide assembly 40 allows the boat lift L to continue to sink to its normal lowered position while the floating bunk system 10 stays on top of the water.

Embodiments of the hull pad float assembly 20 may be comprised of one or more floating bunks that can be tied together utilizing a tank tie bracket 23 with a slotted bolt pattern to allow adjustability between floats 21 and to span different length bunk systems. In some embodiments, the tie bracket 23 may be formed integral to the hull pad float 21. The hull pad float 21 may be comprised of a high-density plastic polymer to allow long life, durability, and cause no damage to the boat hull when the float comes in contact with hull. End brackets 22 include a slotted bolt pattern to adjust span and connect floating bunk hull floats 21 to the hull support columns C at each end E of the hull pads P. The end brackets 22 may be adjusted on either end E to allow for hull pad P leveling, with reference to the water line, to customize to a boater's preference. The adjustability of the hull pad floats 21 allows the adjusted-up pressure to the boat hull to stop the boat in its ideal location every time when the boat is docked at a consistent speed.

In some embodiments of the slide guide assembly 40, the slide guide assembly 40 may include an upper bushing assembly comprised of an upper bushing 45U and a bushing guide housing 44 bolted to the floating end channel 30F. The guide pole 49 may be pinned by a keeper pin 46 in the upper guide bushing assembly). A lower bushing assembly may be comprised of another bushing guide housing 44, a lower bushing 45L, and a guide assembly lock 48. The lower bushing 45L should have adequate clearance to allow the guide pole 49 to have freedom for the floating hull pad system 10 to float freely on the surface of the water without binding on the lower bushing assembly 45L. A retaining ring 42 may be located below the lower bushing 45L.

In some embodiments, when the floating end channel 30F comes in contact with the rising lift's end channel 30L, the guide assembly lock 48 locks the channels 30L, 30F to one another by straddling the upper bushing assembly. This lock 48 is configured such that it will not allow the floating hull pad system 10 to move forward or aft or side to side, thereby avoiding an over stress condition which could cause the guide poles 49 to become deformed. The guide pole 49 may be pinned/locked by a keeper pin 46 so that when the lift L submerges the floating hull pad system 10 will submerge with it for a traditional boat lift experience. The guide poles 49 may have stops 51 on one end 53 so that the floating hull pad system 10 cannot detach from the boat lift. The stop 51 may be a flanged surface, a pin, or a bolt. In embodiments, there is no metal on metal contact in the slide assembly.

In embodiments, floating end channel guide pads 31 may be affixed to the floating end channel 30F avoiding metal on metal contact between it and the boat lift end channel 30L. The floating end channel guide pads 31 can be replaced as a wear items as normal wear occurs over time. The bunk assembly can be raised and lowered by plumbing the hull pad float system 10 to a pneumatic control unit on the lift L.

In other embodiments, the guide pole 49 is a t-shaped guide pole in cross-section Where the guide pole 49 is t-shaped, the upper bushing 45, the guide assembly lock 48, and the channel guide pans 31 may be eliminated.

The invention claimed is:

1. A floating bunk system for use with a boat lift, the floating bunk system comprising:

a first end and a second end, at each first and second end:

a sliding guide assembly including a pair of guide poles, each guide pole of the pair extending in a vertical direction;

an upper end channel extending in a lateral direction and connected to the pair of guide poles; and a lower end channel configured for connection to a boat lift and extending in the lateral direction and including a pair of lower bushings; each lower bushing receiving a respective guide pole of the pair of guide poles;

a pair of floats extending in a longitudinal direction between the first and second ends, the pair of floats located below, and connected to, the lower end channel;

a hull pad assembly extending in the longitudinal direction between the first and second ends, the hull pad assembly including two hull pads spaced apart from one another, the hull pad assembly located above, and connected to, the upper end channel;

the upper end channel being in a fixed position relative to the pair of guide poles;

the lower end channel being slidably vertically displaceable along the guide poles toward and away from the upper end channel.

2. The floating bunk system of claim 1, further comprising:

the guide poles being cylindrical-shaped.

3. The floating bunk system of claim 2, further comprising:

upper end channel further including a pair of upper bushings, each upper bushing receiving a respective guide pole of the pair of guide poles.

4. The floating bunk system of claim 1, further comprising:

the guide poles being t-shaped in cross-section.

5. The floating bunk system of claim 1, further comprising:

each of the two hull pads including flotation.

6. The floating bunk system of claim 1, further comprising:

the upper end channel including one or more guide pads configured to receive the lower end channel.

7. The floating bunk system of claim 1, further comprising:

at least one of the upper and lower end channels including a plurality of spaced apart openings.

8. The floating bunk system of claim 1, further comprising:

the hull pad assembly including a bracket having a plurality of spaced apart openings.

9. The floating bunk system of claim 8, wherein, the bracket is integrally formed with the hull pad assembly.

* * * * *